United States Patent [19]

Nielsen

[11] 3,933,306

[45] Jan. 20, 1976

[54] AIR INLET MEANS FOR AIR CONDITIONING INSTALLATIONS OR THE LIKE(II)

[75] Inventor: Peter Vilhelm Nielsen, Nordborg, Denmark

[73] Assignee: Danfoss A/S, Nordborg, Denmark

[22] Filed: Oct. 31, 1974

[21] Appl. No.: 519,502

Related U.S. Application Data

[63] Continuation of Ser. No. 356,477, May 2, 1973, abandoned.

[30] Foreign Application Priority Data

May 5, 1973 Germany ..... 2222127

[52] U.S. Cl. ..... 236/49; 236/13; 236/99

[51] Int. Cl.[2] ..... F24F 7/04

[58] Field of Search ..... 236/49, 13

[56] References Cited

UNITED STATES PATENTS

| | | | |
|---|---|---|---|
| 2,157,025 | 5/1939 | Snediker | 98/37 |
| 2,749,044 | 6/1956 | Chace | 236/49 |
| 3,103,158 | 9/1963 | Noll | 236/49 |
| 3,669,349 | 6/1972 | Hall, Jr. | 236/49 |
| 3,743,180 | 7/1973 | Perkins et al. | 236/49 |

*Primary Examiner*—William E. Wayner
*Assistant Examiner*—William E. Tapolcai, Jr.

[57] ABSTRACT

An air conditioning system comprising a room to which conditioned air having temperature and volume parameters is delivered. Temperature sensing means is provided for sensing the temperature of the air in the room. Air supply means responsive to the sensing means is provided in an air supply duct. Damper means is also mounted in the duct for varying the effective area of the opening of the duct. A regulating means is provided for controlling the damper to vary the air velocity in accordance with a constant value for the expression $A_r \cdot L^{-3/2}$, where $A_r$ is the Archimedean number, and l represents the effective area of the opening.

9 Claims, 3 Drawing Figures

AIR INLET MEANS FOR AIR CONDITIONING INSTALLATIONS OR THE LIKE(II)

Figure 1:
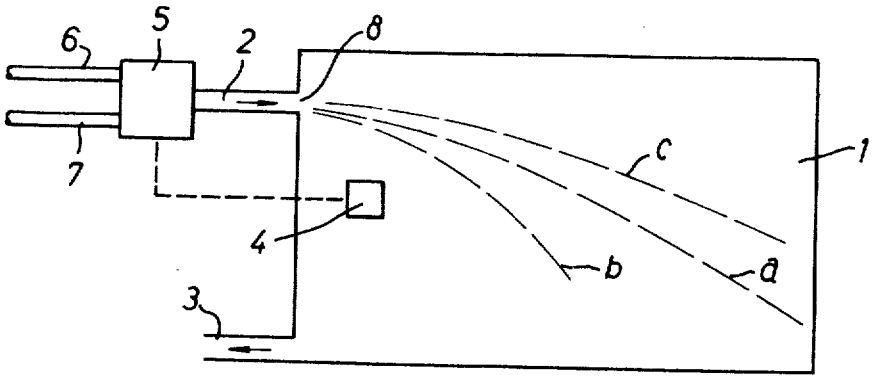

This application is a continuation of Ser. No. 356,477, filed May 2, 1973, now abandoned.

The invention relates to an air inlet means for air conditioning installations or the like having an inlet opening preferably disposed in a substantially vertical plane, at least one parameter of the inlet air being variable.

In air conditioning and ventilating installations the problem arises of the users of air conditioned or ventilated premises being troubled by draughts associated with the changing air. This applies to a greater extent, the higher the velocity or the lower the temperature of the air blown in. The longer the air blown in has to mix with the air in the room, the lower its velocity becomes, the more its temperature rises, and the less unpleasant is any draught.

Efforts have therefore been made, by disposing the inlet opening above the level of the heads of people using the room and by imparting a predetermined inlet angle to the stream of air blown in, to make it follow a path that causes the least possible trouble by draughts. It has been found, however, that when operating the air conditioning installation this flow path varies in an undesirable manner. In some operating conditions troublesome noise is also caused.

The object of the present invention is to provide an air inlet means of the initially described kind in which simple measures ensure that considerably less trouble occurs during operation of the installation.

According to the present invention this object is achieved by making the size of the inlet opening variable in dependence upon the parameter of the air blown in.

This solution is based upon the consideration that the troubles occurring during operation are caused by a change in the parameters of the air blown in. By varying the size of the inlet opening during operation of the installation, as proposed by the invention, these troublesome changes can be wholly or partially counteracted.

In the case of a normal inlet opening in the form of a horizontally extending gap, the height of the gap is preferably variable. This results both in a simple construction and in a simple calculation of the change in the height of the gap in dependence upon a change in parameter value. In the case of circular or other inlet openings the heights and widths of which are of the same order of magnitude, it is preferable to vary both dimensions of the opening, e.g. by altering the radius.

If a fairly large quantity of heat is to be discharged from the room into which air is blown, the temperature of the air blown in is generally reduced, or its volume is increased. The parameters mainly of interest in this case are therefore the temperature and volume of the air blown in. When the temperature of the air blown in drops and its volume is reduced, there arises the danger that air will flow prematurely into the actual zone where it is to dwell. This danger is eliminated by a regulating device which decreases the size of the inlet opening as the temperature of the air blown in drops, or increases the size of the opening as the volume of air blown in rises.

The size of the inlet opening can also be regulated in dependence upon parameters which are in turn dependent upon the primarily regulated parameters of the air blown in. In the case of a variable volume installation, this applies in particular when controlling in dependence upon the pressure of inlet air in a chamber disposed upstream of the inlet opening. It is particularly desirable to keep not only the temperature of the air in the room approximately constant, but also the temperature distribution and then the distribution of the air blown into the room, when the operating conditions vary. This is achieved by means of a regulating device which alters the height l of the gap in such a manner that the expression $A_r.l^{-3/2}$ remains approximately constant, $A_r$ being the Archimedean number. If this requirement is observed, the flow path of the air blown in into the room remains approximately constant, even when the temperature and/or the volume of the air blown in varies.

If the air from the air conditioning installation is blown in relatively close to the ceiling of the room, the so-called Coanda effect occurs. This causes the air to flow parallel with the ceiling over a greater distance than would otherwise be the case if the air were blown into the body of the room. In this case it is advantageous to provide a regulating device or additionally to design the regulating device such that the Archimedean number $A_r$ is kept below the limit value that is critical for causing the Coanda effect. This prevents the stream of air descending into the zone of dwell soon after leaving the inlet opening, as a result of too low a temperature or because of too low a velocity caused by reduction of volume.

It is also advantageous to provide a regulating device or additionally to design the regulating device such that the velocity of the air blown in is kept below a value that is critical as regards causing noise. In this way it is possible to avoid the noise that otherwise often occurs when regulating the volume of air.

It is also possible to effect an adjustment whereby the height of the gap is altered in such a way that the expression $v.l^{1/2}$ is constant. This results in a substantially constant velocity of the air induced into the zone of dwell.

In a preferred arrangement, a common signal generator controls both the parameter of the air blown in and the size of the inlet opening. In particular the common signal generator may be a thermostat which is fitted in the room having the inlet opening. In this way it becomes possible to avoid having a control system which senses the parameter and then alters the size of the inlet opening in dependence thereon.

The size of the inlet opening is preferably variable by means of a adjusting device which is acted upon on one side by a pressure signal and on the other side by an opposing spring. The pressure signal, which can be supplied for example by the vapor pressure of a thermostat having a liquid vapor filling or in particular by a pneumatic system, produces, in conjunction with the spring, a specific size of inlet opening. A particularly advantageous feature in this connection is that with the aid of the spring it is possible to match the required relationship between the change in the parameter and the change in the size of the inlet opening, even if this relationship is not a linear one. In this case it suffices simply to use a spring having a corresponding non-linear characteristic curve.

Figure 2:
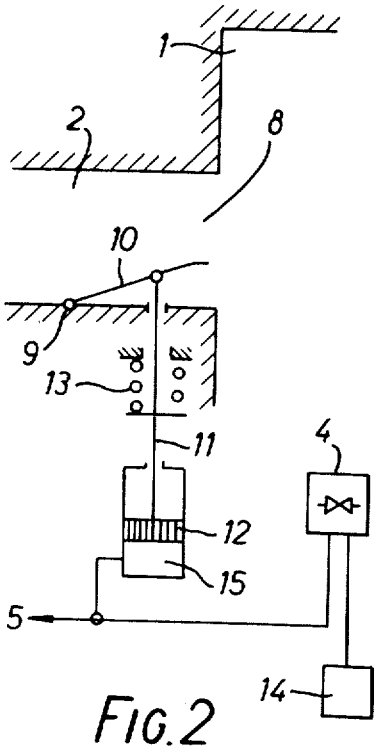
Figure 3:
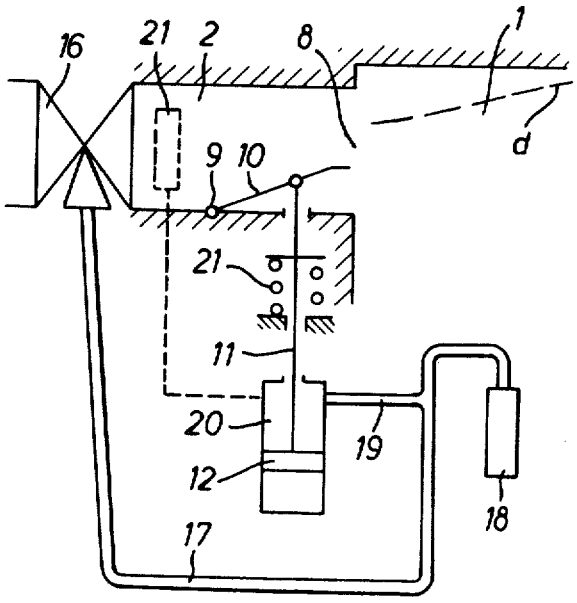

The invention will now be described in greater detail by reference to embodiments illustrated in the drawing, in which:

FIG. 1 is a diagrammatic illustration of an air-conditioned room into which conditioned air is blown in in the normal way, FIG. 2 is a diagrammatic illustration of an inlet means in accordance with the invention, and FIG. 3 is a diagrammatic illustration of another form of inlet means in accordance with the invention.

Air is blown into a room 1 by way of a supply duct 2 and is discharged through an exhaust duct 3. A thermostat 4 fitted in the room controls a mixing unit 5 to which warmer air is supplied through a duct 6 and colder air through a duct 7 (two-duct system).

Depending upon the setting of the mixing unit 5, air having a predetermined temperature enters the room 1 through an inlet opening 8.

A particularly advantageous air flow path is obtained if the inlet opening 8 is located in a side wall at a small distance below the ceiling, and the air blown in strikes the opposite side wall at a predetermined distance above the floor. The air blown in thus reaches the actual zone of dwell only after it has been so warmed by mixing with the air in the room and has acquired so low a velocity that no troublesome draughts occur. This is indicated in FIG. 1 by the curve *a*.

If the temperature of the air blown in drops, then as a result of the greater air density a flow path occurs that corresponds to the curve *b* in FIG. 1. In this case the cool air reaches the zone of dwell at a relatively early stage. The same applies if the velocity of the incoming air correspondingly falls as a result of a reduction in volume. Conversely, a flow path corresponding to the curve *c* in FIG. 1 occurs when the inlet velocity or the inlet temperature rises.

By means of the embodiment of the invention shown in FIG. 2, a flow path corresponding to the curve *a* in FIG. 1 can be obtained substantially over the entire operating range. The inlet opening 8 taken the form of a gap extending in the horizontal direction. The size of the inlet opening 8 can be adjusted with the aid of a baffle 10 which can be swung about a pivot 9. Adjustment takes place with the aid of an adjustment device 11 which is acted upon on the one side by a piston 12 to which pressure is applied and on the other side by a spring 13 applying force in the opposite direction. The thermostat 4 here takes the form of a throttle valve through which air from a pressure-supply unit 14 is passed on the one hand to the mixing unit 5 and on the other hand to a cylinder space 15 below the piston. When the temperature in the room 1 rises, the throttle valve 4 opens to a greater extent and the pressure in its outlet duct rises, so that on the one hand the mixing unit 5 delivers cooler air to the duct 2, and on the other hand the size of the inlet opening 8 is reduced.

If, despite the lowering of the inlet temperature, the flow path indicated by curve *a* in FIG. 1 is to be maintained, the expression $A_r.l^{-3/2}$ must remain approximately constant, the Archimedean number $A_r$ being defined as follows:

$$A_r = \frac{g \cdot \beta (t_2 - t_1) \cdot l}{v^2},$$

wherein $g$ is the gravitation constant, $\beta$ the coefficient of expansion of the air, $t_2$ the temperature of the room, $t_1$ the temperature of the air blown in, $l$ the height of the gap, and $v$ the inlet air velocity. This condition is achieved when the expression $v^2.l^{1/2}$ varies proportionally with the change in the difference in temperature. Since for constant volume per unit time, the inlet velocity $v$ likewise depends upon the size of the inlet opening, the height $l$ of the gap is correspondingly adjusted.

It is of no consequence that the relationship between the height $l$ of the gap and the inlet temperature or the temperature difference is non-linear, since the spring 13 may have a non-linear characteristic curve; for example use can be made of a helical spring wound in conical form, a plurality of springs arranged in parallel and becoming effective one after the other, or a pack of several plate springs of different strengths.

An appropriate relationship can of course also be achieved by means incorporated in the mixing unit or some other converter.

In the arrangement seen in FIG. 3, provision is made for regulating the volume of air blown in. For this purpose a thermostatically controlled throttle element 16 is fitted in the supply duct 2, and this element is controlled through a capillary tube 17 by a sensor 18 fitted in the room 1 and having a liquid vapor filling. The capillary tube has a branch 19 which communicates with the cylinder space 20 above the piston 12. In this way the baffle 10 in the inlet opening 8 is pressed downwardly when the temperature rises and therefore the pressure in the capillary system increases. A spring 21 applying force in the opposite direction establishes a particular position of the baffle 10 for each temperature.

In order to maintain the flow path in accordance with curve *a* in FIG. 1 when using this equipment, even when a change occurs in the inlet velocity, which normally depends upon a change in the volume of air blown in per unit time, it is necessary to provide for keeping the expression $v^2.l^{1/2}$ approximately constant. Such relationship can be readily achieved with the aid of a suitable spring 21.

If the spring 21 that is selected has the effect of keeping $v.l^{1/2}$ constant, then an approximately constant velocity of the air induced into the zone of dwell by the air flow is achieved.

If the ceiling is relatively close to the inlet opening 8 as shown in FIG. 3, the resultant path of flow is not, in practice, as shown in FIG. 1. Instead, as a result of the Coanda effect, a flow path is obtained that corresponds roughly to the curve *d* in FIG. 3. If the inlet means is so designed that this flow path represents the normal operating condition (i.e. the path that will be maintained under all operating conditions) it is advisable so to regulate the size of the inlet opening 8 that the Archimedean number $A_r$ does not exceed a predetermined critical value, for example at too low an inlet velocity as a result of a small volume of air blown in. Thus, when regulating the volume the Archimedean number can be kept constant if when making an adjustment $l/v^2$ is maintained constant.

A pressure sensor 21 is shown in broken lines in FIG. 3, and this ascertains the pressure in the supply duct 2 downstream of the throttle element 16, and in dependence thereon supplies a pressure signal to the cylinder space 20, there being then no branch pipe 19.

A further point of view can also be considered. If as a result of an excessively great inlet volume for a fixed size of inlet opening, the inlet velocity were to become so great that unpleasant noise occurred, then by increasing the size of the inlet opening the inlet velocity can be held at a value below the critical noise producing level.

The inlet means of the invention is, of course, also suitable when the control of the air conditioning installation includes both control of the temperature and control of the volume of the air blown in. In each case the variable size of the inlet opening is a parameter which can be varied in addition to the main parameters of the inlet air (temperature and volume), in order to reduce or completely eliminate troubles hitherto occurring during the operation of an air conditioning installation. The relationship can also be achieved by altering the size of the inlet opening not over the entire operating range but merely over the limiting parts of the range e.g. for preventing too low or too high an inlet velocity. Further possibilities are those of effecting the main adjustment by altering a parameter of the air blown in and achieving particular flow conditions by altering the size of the inlet opening in conjunction with a variation of the other parameter.

If the inlet opening is not in the form of a rectangular gap, but is circular for example, slightly different forms apply. In this case for example the expression $A_r.d^{-2}$ should be kept constant in order to maintain a predetermined flow path, $d$ in this expression being the diameter of the inlet opening and being used in the Archimedean number instead of the height $l$ of the gap.

By means of the theory of geometrically similar spaces in fluid dynamics, it is also possible to determine the conditions for other forms of inlet opening.

Instead of a pneumatically operating thermostat, use can also be made of an electrical thermostat in conjunction with an electrically or magnetically driven actuating device.

I claim:

1. An air conditioning system comprising a room to which conditioned air having temperature and volume parameters is delivered, temperature sensor means for sensing the temperature of air in said room, an air duct having an opening defined in one of said walls, air supply means responsive to said temperature sensor means for supplying a constant volume of air through said air duct having a dependent temperature which tracks said sensed temperature, damper means in said air duct for varying the effective area of said opening, regulating means responsive to said temperature sensor means for modulatingly moving said damper means for varying the air velocity in accordance with a constant value for expression $A_r.l^{-3/2}$ where $l$ represents the effective area of said opening and $A_r$ is the Archimedean number.

2. An air conditioning system according to claim 1 wherein said varied parameter is said volume of said delivered air.

3. An air conditioning system according to claim 1 wherein said opening is in a vertical plane and has a rectangular shape.

4. An air conditioning system according to claim 1 including a chamber on the upstream side of said opening, air treatment means in said chamber for varying one of said parameters, said air treatment means being responsive to and controlled by said temperature sensor means.

5. An air conditioning system according to claim 1 wherein said sensor means is of the liquid vapor type, said regulating means being a fluid pressure device operable in a closing direction by pressurized fluid and in a closed direction by spring biasing means.

6. An air conditioning system according to claim 5 wherein said spring biasing means has a nonlinear characteristic curve.

7. An air conditioning system according to claim 2 wherein said air treatment means includes a throttle valve.

8. An air conditioning system according to claim 1 wherein said sensor means is of the liquid vapor type, said regulating means being a fluid pressure device operable in an opening direction by spring biasing means.

9. An air conditioning system according to claim 8 wherein said psring means has a nonlinear characteristic curve.

* * * * *